US007121452B2

(12) United States Patent
Boriani et al.

(10) Patent No.: US 7,121,452 B2
(45) Date of Patent: Oct. 17, 2006

(54) CARTON OF A PLURALITY OF PACKETS OF CIGARETTES

(75) Inventors: Silvano Boriani, Bologna (IT); Fiorenzo Draghetti, Medicina (IT)

(73) Assignee: G.D. S.p.A., Bologna (IT)

( * ) Notice: Subject to any disclaimer, the term of this patent is extended or adjusted under 35 U.S.C. 154(b) by 0 days.

(21) Appl. No.: 10/240,017

(22) PCT Filed: Mar. 26, 2001

(86) PCT No.: PCT/IB01/00487

§ 371 (c)(1),
(2), (4) Date: Sep. 27, 2002

(87) PCT Pub. No.: WO01/72606

PCT Pub. Date: Oct. 4, 2001

(65) Prior Publication Data

US 2003/0089763 A1 May 15, 2003

(30) Foreign Application Priority Data

Mar. 31, 2000 (IT) ..... BO2000A0179

(51) Int. Cl.
*A01K 1/00* (2006.01)
*B65D 17/00* (2006.01)
*B65D 85/10* (2006.01)

(52) U.S. Cl. ..... 229/122.1; 229/221; 229/243; 206/273

(58) Field of Classification Search ..... 229/122.1, 229/122.11, 221, 172, 120.33, 120.24, 123, 229/243; 206/273
See application file for complete search history.

(56) References Cited

U.S. PATENT DOCUMENTS

| | | | | |
|---|---|---|---|---|
| 1,667,975 | A * | 5/1928 | Labombarde | 229/152 |
| 1,711,368 | A * | 4/1929 | Vuccino | 229/103.2 |
| 1,725,372 | A * | 8/1929 | Richman | 229/242 |
| 2,803,391 | A | 8/1957 | Koeble | |
| 2,875,938 | A * | 3/1959 | Bramhill | 229/242 |
| 3,165,249 | A * | 1/1965 | Peck | 225/43 |
| 3,183,614 | A | 5/1965 | Loderhose | |
| 3,204,762 | A * | 9/1965 | Shanok et al. | 206/738 |

(Continued)

FOREIGN PATENT DOCUMENTS

DE 29503238.3 4/1995

(Continued)

*Primary Examiner*—Tri M. Mai
(74) *Attorney, Agent, or Firm*—Timothy J. Klima

(57) ABSTRACT

Packets (2) of cigarettes are packed in multiples adopting a rigid carton (1) of parallelepiped shape presenting two end faces (11, 12) coinciding with the flanks (13, 14), and four side faces (3, 4, 5, 6) of which two coincide with the bottom (10) and the top (8). One of the side faces (3, 4, 5, 6) constituting the front (7) incorporates a removable portion (15) serving to mask on openable cover (19) that can be rotated about a hinge (20) between a position in which the carton (1) is closed, and an open position exposing the inside of the wrapper, the cover (19) is provided with a pair of guiding and stabilizing members (22) attached permanently to two opposite edges (23), each occupying a plane disposed transversely to the hinge (20), which are interposed and slidable between the flanks (13, 14) and the surfaces of the packets (2) inside, whilst the free edge (21) is strengthened by a reinforcing fold (24) and fashioned with a cutaway portion (25) by means of which the cover (19) can be gripped and pulled open.

20 Claims, 4 Drawing Sheets

U.S. PATENT DOCUMENTS

| | | | | |
|---|---|---|---|---|
| 3,593,908 | A * | 7/1971 | Desmond et al. | 229/122 |
| 4,138,052 | A * | 2/1979 | Torigian | 229/120.32 |
| 4,493,453 | A * | 1/1985 | LeDrew | 229/120.18 |
| 4,752,029 | A | 6/1988 | Buford | |
| 2002/0074248 | A1 * | 6/2002 | Venable | 206/242 |

FOREIGN PATENT DOCUMENTS

| | | |
|---|---|---|
| DE | 19729895 | 6/1998 |
| EP | 0671342 | 9/1995 |
| FR | 2670182 | 6/1992 |

* cited by examiner

CARTON OF A PLURALITY OF PACKETS OF CIGARETTES

This application is the National Phase of International Application PCT/IB01/00487 filed Mar. 26, 2001 which designated the U.S. and that International Application was published under PCT Article 21(2) in English.

TECHNICAL FIELD

"The present invention relates to a carton of a plurality of packets of cigarettes."

BACKGROUND ART

It is the conventional practice for packets of cigarettes to be packaged in multiples using rigid wrappers commonly known as cartons, which appear substantially parallelepiped in shape.

One type of carton consists in a wrapper of flat and elongated shape exhibiting four longitudinal faces, including two main faces and two narrower faces, and two transverse end faces.

One of the panels coinciding with one of the two main longitudinal faces functions as a lid, secured by a longitudinal flap sealed along one of the two adjoining narrower longitudinal faces. The lid in this instance cannot be closed stably once the seal is broken, and in effect the general practice is to discard these cartons once opened since they do not protect the packets thereafter during the period of consumption.

Another carton of comparable type consists in a rigid wrapper appearing as a container, of cupped embodiment, with a similarly cupped lid hinged to the container in such a manner that one open end of the selfsame container can be closed. The lid is retained in the closed position by means of a frame projecting from the open end of the container.

These cartons are designed to serve as storage containers until all of the packets they hold have been used up, although the flat diecut blanks from which they are fashioned require a relatively large quantity of wrapping material for their preparation and there is a significant amount of waste wrapping material generated in manufacture. Moreover, a lid hinged to one end of the container affords ease of access only to those packets in the container that are positioned nearer to the open end, whereas the user is unable to see the packets positioned at the bottom of the container.

The object of the present invention is to provide a rigid wrapper that will permit of overcoming the aforementioned drawbacks simply and economically.

DISCLOSURE OF THE INVENTION

The stated object is realized according to the invention in a rigid wrapper for a plurality of packets of cigarettes, typically of parallelepiped geometry presenting two end faces, and four side faces of which two constitute a bottom and a top, characterized in that it comprises an openable cover coinciding with at least one of the faces, rotatable about a relative hinge between a position in which the wrapper is closed and an open position affording access to the inside of the wrapper, and in that the cover is furnished with at least one guiding and stabilizing member lying in a plane transverse to the hinge.

The invention will now be described in detail, by way of example, with the aid of the accompanying drawings, in which.

Figure 1:
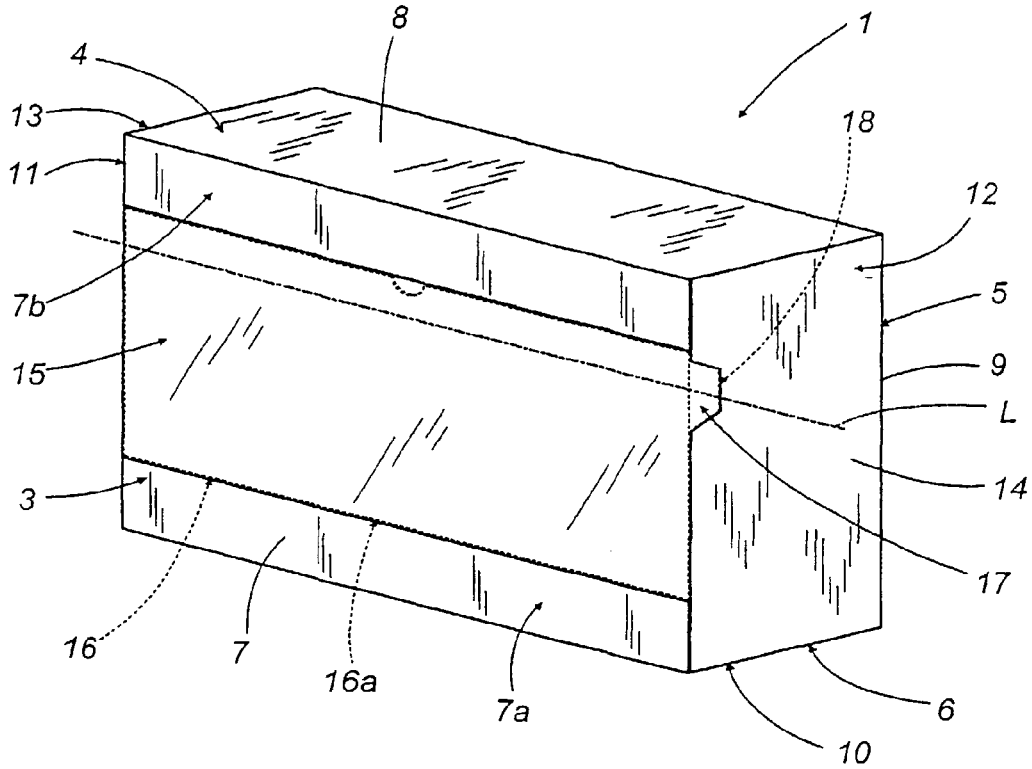
FIG. 1 illustrates a rigid wrapper according to the present invention, viewed schematically and in perspective.
Figure 4:
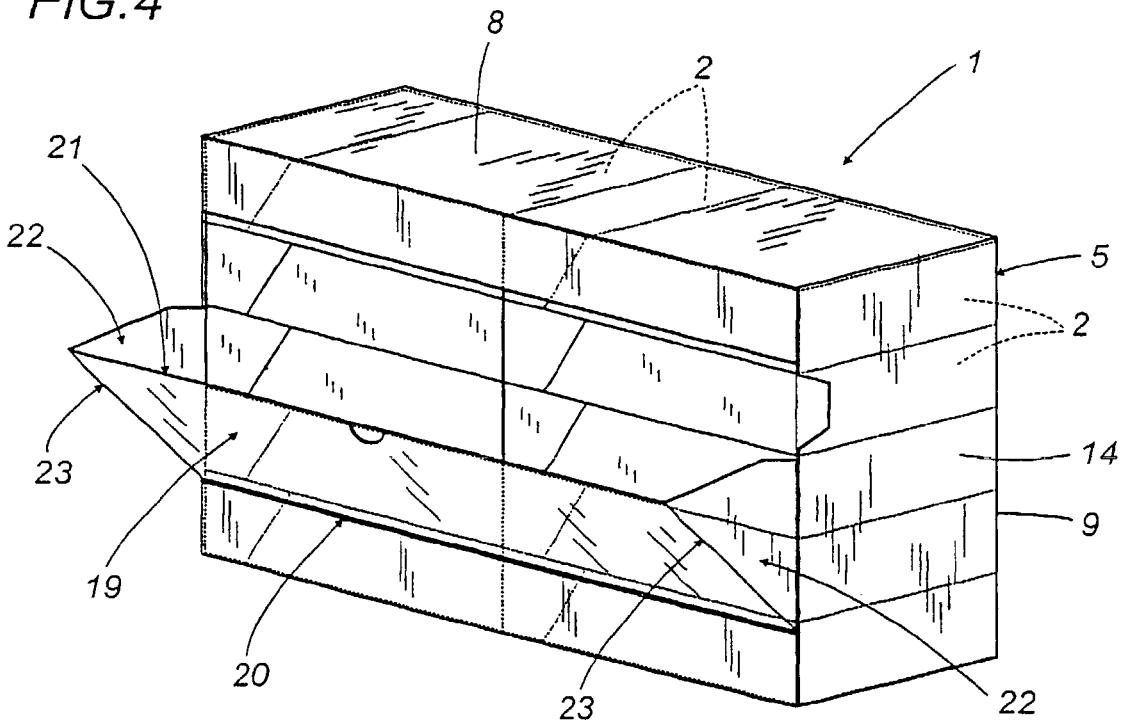
FIG. 4 shows the wrapper of FIG. 1, viewed schematically and in perspective, illustrating an intermediate step of the opening procedure.
Figure 5:
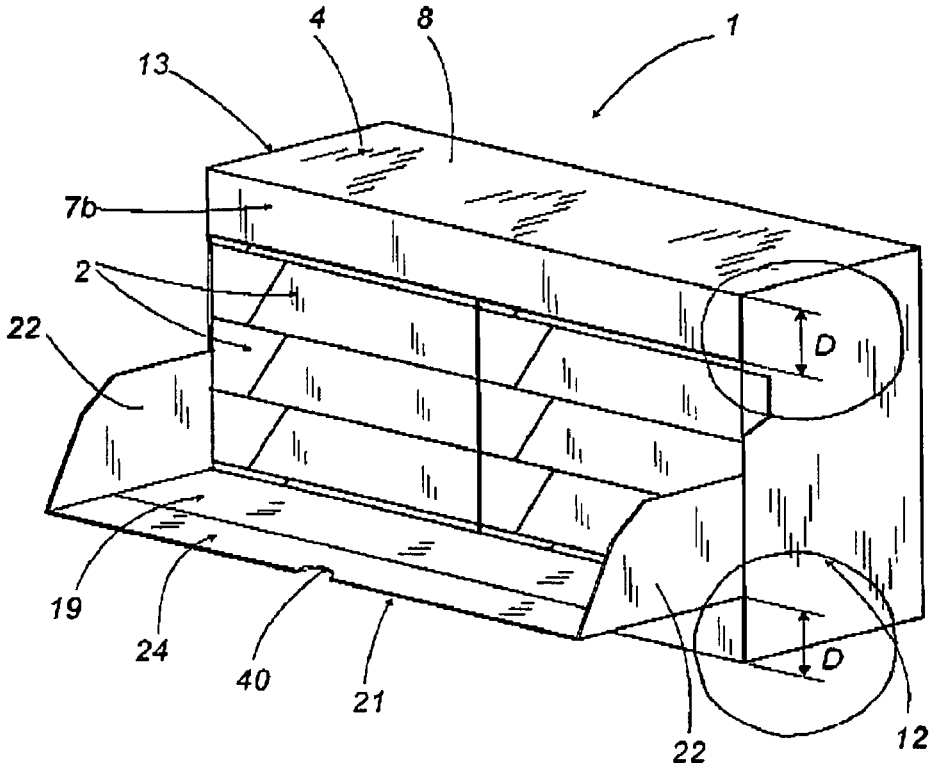
FIG. 5 shows the wrapper of FIG. 1, viewed schematically and in perspective and fully opened.

With reference to FIGS. 1 . . . 5 of the accompanying drawings, 1 denotes a rigid wrapper or carton of substantially parallelepiped geometry that serves to contain a plurality of packets 2 of cigarettes, shown in FIGS. 4 and 5.

In the example of FIGS. 1 to 5, the wrapper 1 exhibits an elongated appearance referable to a predominating longitudinal axis L, presenting four side faces 3, 4, 5 and 6 which extend parallel to the axis L and coincide respectively with four side walls 7, 8, 9 and 10 coinciding in turn with the front, top, back and bottom of the wrapper 1. Also indicated are two end faces 11 and 12 disposed transversely to the axis L, afforded by respective transverse walls 13 and 14 constituting the flanks of the wrapper 1.

Figure 2:
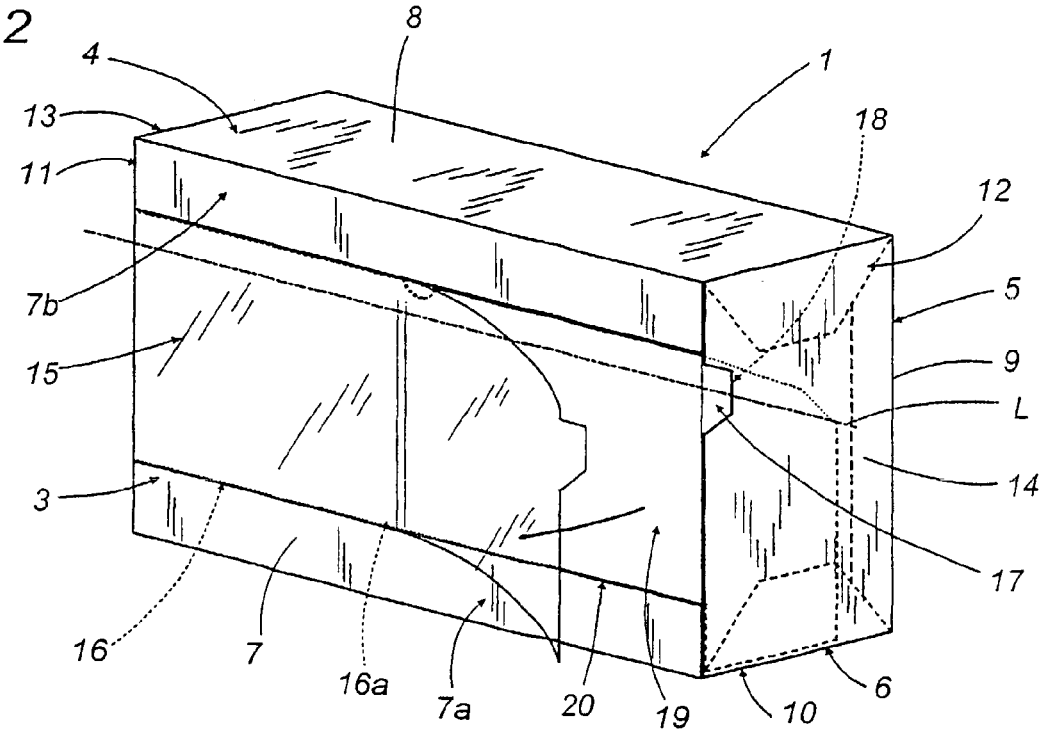
FIG. 2 shows the wrapper of FIG. 1, viewed schematically and in perspective, illustrating a first preparatory step of the opening procedure.

As discernible from FIGS. 1 and 2, the front 7 comprises a removable portion 15 of substantially rectangular appearance delimited peripherally by a tear and/or perforation line 16.

The length dimension of the removable portion 15 as measured along the predominating axis L is substantially identical to that of the front 7, whereas the width dimension, measured transversely to the axis L, is less than that of the front 7.

In particular, the removable portion 15 is placed centrally in relation to the front 7, in such a way that the two branches of the tear line 16 lying parallel to the predominating axis L, denoted 16*a* and 16*b*, are equidistant from the two corner edges of the wrapper 1 along which the front 7 meets the bottom 10 and the top 8, respectively.

Also illustrated in FIGS. 1 and 2 is a tab 17 integral with the removable portion 15, delimited by a further tear and/or perforation line 18 in the transverse wall 14 coinciding with the end face denoted 12.

Figure 3:
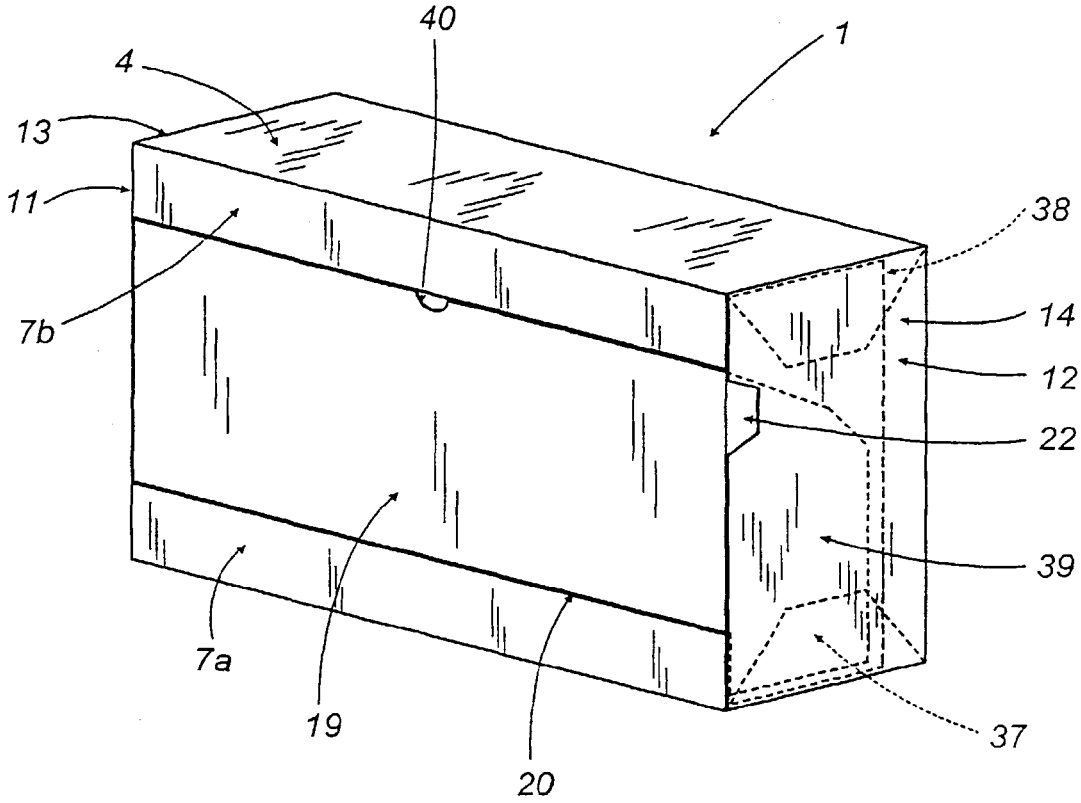
FIG. 3 shows the wrapper of FIG. 1, viewed schematically and in perspective, and ready to be opened.

As illustrated in FIGS. 2 and 3, the wrapper 1 comprises an openable cover 19 behind the front 7, rotatable about a respective hinge line 20 between a position in which the wrapper 1 is closed (see FIG. 3) and a position in which the wrapper 1 is fully open (see FIG. 5) allowing the packets 2 to be withdrawn. More precisely, the hinge line 20 and the bottom branch 16*a* of the tear line 16 extend mutually parallel and substantially coincide one with another.

The front 7 exhibits a portion denoted 7*a* lying between the bottom branch 16*a* of the tear and/or perforation line 16 and the corner edge joining the front 7 and the bottom 10 of the wrapper 1, and a portion denoted 7*b* lying between the top branch 16*b* of the tear and/or perforation line 16 and the corner edge joining the front 7 and the top 8, both of which serve to restrain the packets 2 inside the wrapper 1.

In the same way as described previously for the removable portion 15, the cover 19 can be placed centrally in relation to the side face 3, in such a manner that the hinge 20 and the free edge 21 lie equidistant by a distance "D" from the corner edges of the wrapper 1 along which the front 7 meets the bottom 10 and the top 8, respectively: in short so that the outline of the cover 19 coincides substantially with the tear line 16 of the removable portion 15. See FIG. 5.

As discernible from FIGS. 4 and 5, the cover 19 comprises two guiding and stabilizing members 22 occupying respective planes disposed transversely to the hinge 20 and integral with the two opposite lateral edges 23 of the cover 19. More exactly, each one of the two members 22 is interposed and slidable between a respective transverse wall 13 and 14 and the packets 2 inside the wrapper 1.

As indicated in FIG. 5, the free edge 21 of the cover 19 is provided with a reinforcing fold 24 and fashioned with a cutaway portion 25, positioned at an intermediate point along the fold, by means of which to pull the cover 19 open.

Figure 6:
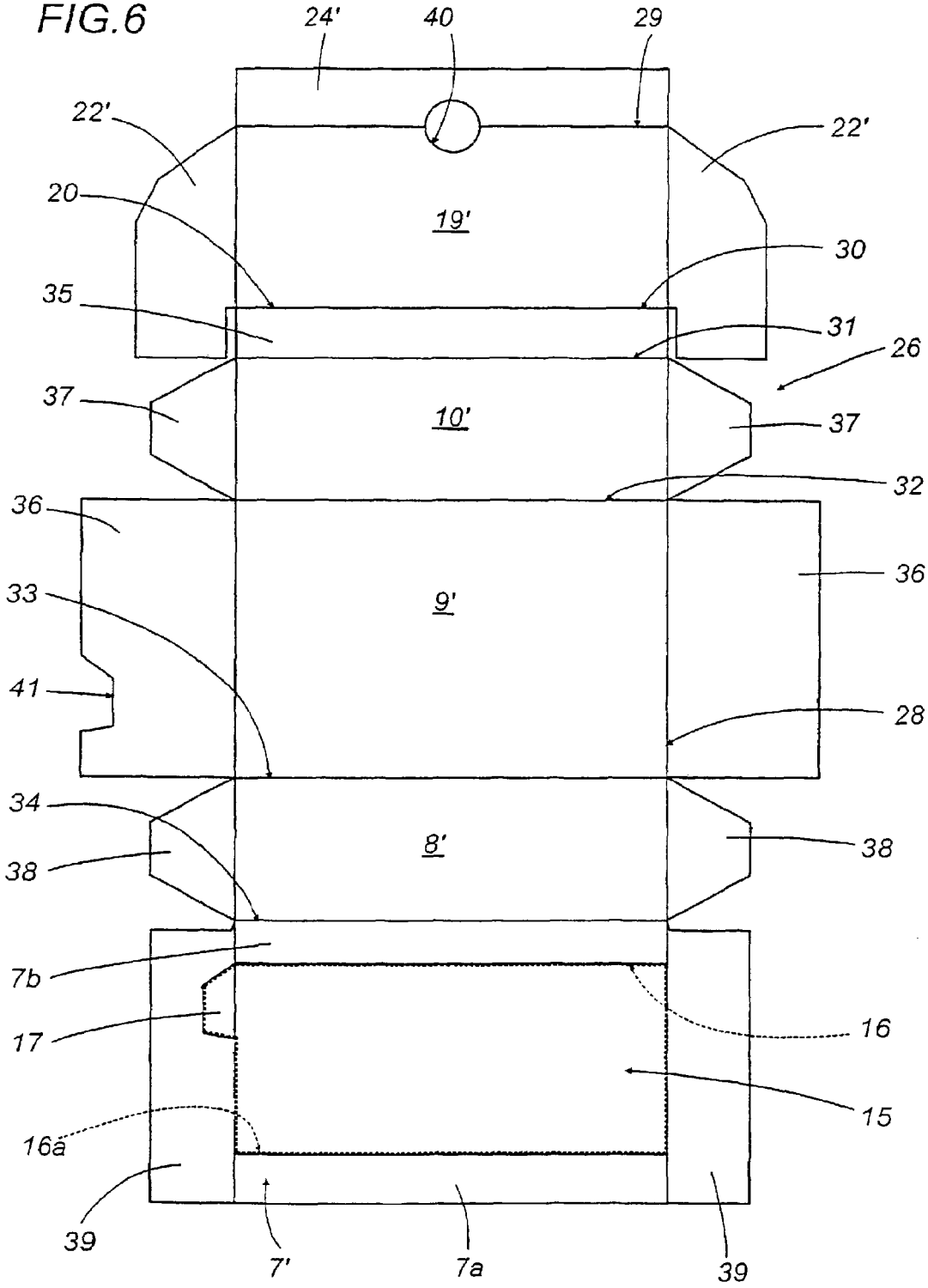
FIG. 6 is the schematic plan view of a diecut blank from which to fashion the wrapper illustrated in FIGS. 1 to 5.

With reference now to FIG. 6, the wrapper 1 is fashioned from a flat diecut blank 26 of which the component parts will be referred to where possible using the same numbers, primed, as those used to identify the corresponding parts of the wrapper 1.

The blank 26 appears substantially rectangular in shape and exhibits two longitudinal crease lines, denoted 27 and 28, also a plurality of transverse crease lines denoted 29 . . . 34.

The transverse crease lines 29 . . . 34 combine with the longitudinal crease lines 27 and 28 to define a succession of panels compassed between the selfsame longitudinal crease lines, namely a first central panel 9' extending between the transverse crease lines denoted 32 and 33, and a second panel 10' and a third panel 8' one on either side of the central panel 9', extending between the transverse crease lines denoted 31 and 32 and 33 and 34 respectively.

The third panel 8' is joined along one transverse crease line 34 to a fourth and endmost panel 7', whilst the second panel 10' is joined by way of a band 35 extending between the two transverse crease lines denoted 31 and 30 to a fifth panel 19', and this in turn is joined along the remaining crease line 29 to a sixth and endmost panel 24'.

The first panel 9' coincides with the back 9 of the erected wrapper 1, the second panel 10' with the bottom 10, the third panel 8' with the top 8, the fourth panel 7' with the front 7, the fifth panel 19' with the openable cover 19 and the sixth panel 24' with the reinforcing fold 24.

The fourth panel 7' exhibits the tear and/or perforation line 16 serving to define the removable portion 15 of the wrapper 1, and in particular, the bottom branch 16*a* of the line delimits the bottom portion 7*a* of the front 7 and the top branch 16*b* of the line delimits the top portion 7*b*.

The transverse crease line 30 separating the fifth panel 19' from the band 35 coincides with the hinge line 20 of the cover 19 and, more exactly, the band 35 will be positioned behind and breasted with the bottom portion 7*a* of the fourth panel 7' in the erected wrapper 1.

The first panel 9' is associated by way of the longitudinal crease lines 27 and 28 with a first pair of flaps 36 destined to become the end walls or flanks 13 and 14 of the erected wrapper 1.

The second panel 10' and the third panel 8' are associated by way of the two longitudinal crease lines 27 and 28 with a second and a third pair of flaps 37 and 38 destined to function as end folds securing the bottom 10 and the top 8 of the erected wrapper 1 to the flanks 13 and 14, as indicated by the phantom lines in FIG. 3.

The fourth and endmost panel 7' is associated by way of the longitudinal crease lines 27 and 28 with a fourth pair of flaps 39 functioning as end folds by which the front 7 of the wrapper 1 is secured to the flanks 13 and 14, as illustrated in FIG. 3.

Finally, the fifth panel 19' is associated by way of the longitudinal crease lines 27 and 28 with a fifth pair of flaps 22' destined to function as the guiding and stabilizing members 22 of the cover 19.

The blank 26 also exhibits a hole 40 positioned at an intermediate point on the transverse crease line denoted 29 and in such way that when the sixth panel 24' is folded back and flattened against the fifth panel 19', the resulting void will provide the cutaway portion 25 by means of which to pull the cover 19 open.

In addition, one of the flaps 39 associated with the fourth panel 7' will present the aforementioned tear and/or perforation line 18 serving to delimit the tab 17, which exhibits a substantially U-shaped outline and is positioned to coincide with a gap in the tear and/or perforation line 16 delimiting the removable portion 15 of the wrapper 1. It will be observed also that the flap 36 destined to overlap the flap 39 with the tear line 18 is fashioned with a notch 41 to facilitate the action of lifting the tab 17.

The wrapper 1 is erected by bending and folding the various panels and flaps of the blank 26 in a manner that will be apparent from the foregoing description. Thereafter, when the moment comes to expose the contents, the user will grip the tab 17 of the removable portion 15 and pull it back as illustrated in FIGS. 1 and 2 so as to reveal the cover 19 underneath, whereupon it becomes possible to gain access to the inside of the carton, take out one or more packets 2 and reclose the cover 19.

The advantages of the invention consist in the fact that the wrapper 1 can be kept intact for the duration of use as the packets 2 are consumed one by one, and moreover, as discernible from FIG. 5, the fact that the wrapper 1 can be exploited by retailers as a display carton, with the removable portion 15 carrying promotional messages printed directly on the carton material or on coupons of whatever type attached to the selfsame portion 15.

Finally, as illustrated in FIG. 6, the blank 26 from which the wrapper 1 is fashioned is a diecut of substantially traditional type generating little waste, and consequently can be utilized on existing cartoners without the need for modifications of any great significance.

The invention claimed is:

1. A carton of cigarettes containing a plurality of packets of cigarettes, each packet having parallelepiped geometry and containing a plurality of cigarettes, the carton having parallelepiped geometry and presenting two end faces, and four side faces of which two constitute a bottom and a top, wherein it comprises an openable cover coinciding with at least one front face, rotatable about a relative hinge between a position in which the carton is closed and a fully open position allowing the packets to be withdrawn; the cover being furnished with at least one guiding and stabilizing member lying in a plane transverse to the hinge, the packets being closely packed within the carton such that there is an orderly array of at least three rows and two columns of packets, the carton including a top front portion positioned above the openable cover and a bottom front portion positioned below the openable cover, the top and bottom front portions restraining respective top and bottom rows of packets in the carton when the openable cover is open while allowing access, through the openable cover, to each row of packets intermediate the top and bottom rows of packets, the top and bottom front portions restraining the respective top and bottom rows of packets until packets have been removed from the carton from at least one intermediate row of packets; wherein at least one side wall of the carton includes a notched portion open to the front and one side of the carton such that when the openable cover is in the closed position, the at least one guiding and stabilizing member is positioned between the notched portion and the packets to prevent access to the packets via the notched portion, and, when the openable cover is in the open position, the at least one guiding and stabilizing member is positioned away from the notched portion such that the notched portion of the side wall exposes a side-facing surface of at least one packet to facilitate grasping the packet for removal from the carton.

2. A carton as in claim 1, wherein one dimension of the cover measured in a direction parallel to the hinge is substantially identical to the dimension of the carton measured in the same direction, the guiding and stabilizing member being integral with one edge of the cover and interposed between one wall of the carton, coinciding with one of the faces and the packets inside the wrapper.

3. A carton as in claim 2, wherein the cover comprises two guiding and stabilizing members integral with two opposite edges of the selfsame cover.

4. A carton as in claim 3, wherein one dimension of the cover measured in a direction transverse to the hinge is less than the corresponding dimension of the carton measured along the same direction.

5. A carton as in claim 4, wherein the cover is disposed in a centered position on the face with which it coincides, in such a way that the hinge and the free edge of the cover lie at identical distances from respective corner edges of the carton.

6. A carton as in claim 1, wherein the front face is furnished with a portion delimited by tear lines, extending substantially around the peripheral outline of the cover, in such a way that it can be removed to afford access to the cover.

7. A carton as in claim 6, wherein the removable portion affords a tab located and formed, by a tear line, on one face coinciding with one side face of the carton adjacent to the wall of the carton which masks the cover.

8. A carton as in claim 7, wherein the removable portion provides a support for promotional messages and/or coupons.

9. A carton as in claim 8, fashioned from a substantially rectangular fiat diecut blank presenting two longitudinal crease lines and a plurality of transverse crease lines combining to delimit a first central panel coinciding with the back, a second panel and a third panel disposed on opposite sides of the first panel and coinciding respectively with the bottom and the top, a fourth panel connected to the third panel and coinciding with the wall which masks the cover and coincides with the front, directly opposite the back, also a fifth panel connected to the second panel by way or a transversely disposed band and coinciding with the openable cover; the two longitudinal crease lines also delimiting a first pair of flaps associated one on either side with the first panel, second and third pairs of flaps associated respectively one on either side with the second and the third panel, a fourth pair of flaps associated one on either side with the fourth panel, and a fifth pair of flaps associated one on either side with the fifth panel and coinciding with the guiding and stabilizing members of the cover.

10. A carton as in claim 9, wherein the fifth panel is connected to the band along a respective transverse crease line coinciding with the hinge, and each flap of the fifth pair presents an appendage extending in a direction parallel to the respective longitudinal crease line through a distance equal to the corresponding dimension of the band as measured along the self same direction parallel to the longitudinal crease line.

11. A carton as in claim 9, wherein the fifth panel is associated by way of the edge remote from the central panel with a sixth panel destined ultimately to be bent along the relative transverse crease line and flattened against the inside face of The fifth panel to provide a reinforcing fold along the pulling edge of the openable cover.

12. A carton as in claim 11, wherein the blank affords a hole located on the transverse crease line between the sixth panel and the fifth panel in such a way that when the sixth panel is bent along the relative transverse crease line and flattened against the inside face of the fifth panel, it will generate a cutaway portion that can be used to pull and open the cover.

13. A carton as in claim 1, wherein the cover comprises two guiding and stabilizing members integral with two opposite edges of the selfsame cover.

14. A carton as in claim 1, wherein one dimension of the cover measured in a direction transverse to the hinge is less than the corresponding dimension of the carton measured along the same direction.

15. A carton as in claim 6, wherein the removable portion provides a support for promotional messages and/or coupons.

16. A carton as in claim 1, fashioned from a substantially rectangular flat diecut blank presenting two longitudinal crease lines and a plurality of transverse crease lines combining to delimit a first central panel coinciding with the back, a second panel and a third panel disposed on opposite sides of the first panel and coinciding respectively with the bottom and the top, a fourth panel connected to the third panel and coinciding with the wall which masks the cover and coincides with the front, directly opposite the back, also a fifth panel connected to the second panel by way or a transversely disposed band and coinciding with the openable cover; the two longitudinal crease lines also delimiting a first pair of flaps associated one on either side with the first panel, second and third pairs of flaps associated respectively one on either side with the second and the third panel, a fourth pair of flaps associated one on either side with the fourth panel, and a fifth pair of flaps associated one on either side with the fifth panel and coinciding with the guiding and stabilizing members of the cover.

17. A carton as in claim 2, fashioned from a substantially rectangular fiat diecut blank presenting two longitudinal crease lines and a plurality of transverse crease lines combining to delimit a first central panel coinciding with the back, a second panel and a third panel disposed on opposite sides of the first panel and coinciding respectively with the bottom and the top, a fourth panel connected to the third panel and coinciding with the wall which masks the cover and coincides with the front, directly opposite the back, also a fifth panel connected to the second panel by way or a transversely disposed band and coinciding with the openable cover; the two longitudinal crease lines also delimiting a first pair of flaps associated one on either side with the first panel, second and third pairs of flaps associated respectively one on either side with the second and the third panel, a fourth pair of flaps associated one on either side with the fourth panel, and a fifth pair of flaps associated one on either side with the fifth panel and coinciding with the guiding and stabilizing members of the cover.

18. A carton as in claim 3, fashioned from a substantially rectangular fiat diecut blank presenting two longitudinal crease lines and a plurality of transverse crease lines combining to delimit a first central panel coinciding with the back, a second panel and a third panel disposed on opposite sides of the first panel and coinciding respectively with the bottom and the top, a fourth panel connected to the third panel and coinciding with the wall which masks the cover and coincides with the front, directly opposite the back, also a fifth panel connected to the second panel by way or a transversely disposed band and coinciding with the openable cover; the two longitudinal crease lines also delimiting a first pair of flaps associated one on either side with the first panel, second and third pairs of flaps associated respectively one on either side with the second and the third panel, a fourth pair of flaps associated one on either side with the fourth panel, and a fifth pair of flaps associated one on either side with the fifth panel and coinciding with the guiding and stabilizing members of the cover.

19. A carton as in claim 4, fashioned from a substantially rectangular fiat diecut blank presenting two longitudinal crease lines and a plurality of transverse crease lines combining to delimit a first central panel coinciding with the back, a second panel and a third panel disposed on opposite sides of the first panel and coinciding respectively with the bottom and the top, a fourth panel connected to the third panel and coinciding with the wall which masks the cover and coincides with the front, directly opposite the back, also a fifth panel connected to the second panel by way or a transversely disposed band and coinciding with the openable cover; the two longitudinal crease lines also delimiting a first pair of flaps associated one on either side with the first panel, second and third pairs of flaps associated respectively one on either side with the second and the third panel, a fourth pair of flaps associated one on either side with the fourth panel, and a fifth pair of flaps associated one on either side with the fifth panel and coinciding with the guiding and stabilizing members of the cover.

20. A carton as in claim 5, fashioned from a substantially rectangular fiat diecut blank presenting two longitudinal crease lines and a plurality of transverse crease lines combining to delimit a first central panel coinciding with the back, a second panel and a third panel disposed on opposite sides of the first panel and coinciding respectively with the bottom and the top, a fourth panel connected to the third panel and coinciding with the wall which masks the cover and coincides with the front, directly opposite the back, also a fifth panel connected to the second panel by way or a transversely disposed band and coinciding with the openable cover, the two longitudinal crease lines also delimiting a first pair of flaps associated one on either side with the first panel, second and third pairs of flaps associated respectively one on either side with the second and the third panel, a fourth pair of flaps associated one on either side with the fourth panel, and a fifth pair of flaps associated one on either side with the fifth panel and coinciding with the guiding and stabilizing members of the cover.

* * * * *